United States Patent [19]

Snowdon

[11] 4,006,880

[45] Feb. 8, 1977

[54] SIDE BOARD SECURING DEVICE

[76] Inventor: Raymond Snowdon, Long Acre Nechells, Birmingham, B7 5JR, England

[22] Filed: Feb. 13, 1976

[21] Appl. No.: 657,902

[30] Foreign Application Priority Data

Feb. 18, 1975 United Kingdom ..... 6803/75

[52] U.S. Cl. ..... 249/106; 249/202

[51] Int. Cl.[2] ..... B22D 7/10

[58] Field of Search ..... 249/106, 197, 202, 219 R

[56] References Cited

UNITED STATES PATENTS

| | | | |
|---|---|---|---|
| 1,905,616 | 4/1933 | Zanella | 249/219 R X |
| 3,856,258 | 12/1974 | Dowidchuk et al. | 249/202 X |

*Primary Examiner*—Robert D. Baldwin

*Attorney, Agent, or Firm*—Caesar, Rivise, Bernstein & Cohen, Ltd.

[57] ABSTRACT

A hot top assembly for an ingot mould includes a number of side boards which line the walls of the mould, leaving at each corner of the mould a gap which tapers downwardly in width between the edges of two of the side boards, each of these gaps receiving a wedge member constituted by a plate which tapers downwardly in width and has at its downwardly extending edges integral margins shaped to engage both the end surfaces and the inner surfaces of the side boards. The two marginal portions of the wedge member are divided transversely into separate flanges, each extending over only part of the length of the wedge member, some of these flanges projecting forwardly from the central plate portion of the member, while the remainder project rearwardly therefrom. The two flanges or sets of flanges at each edge of the wedge member lying at such an angle to one another that they receive and locate the corresponding side board and the assembly is held firmly in position in the ingot mould.

8 Claims, 3 Drawing Figures

SIDE BOARD SECURING DEVICE

Figure 1:
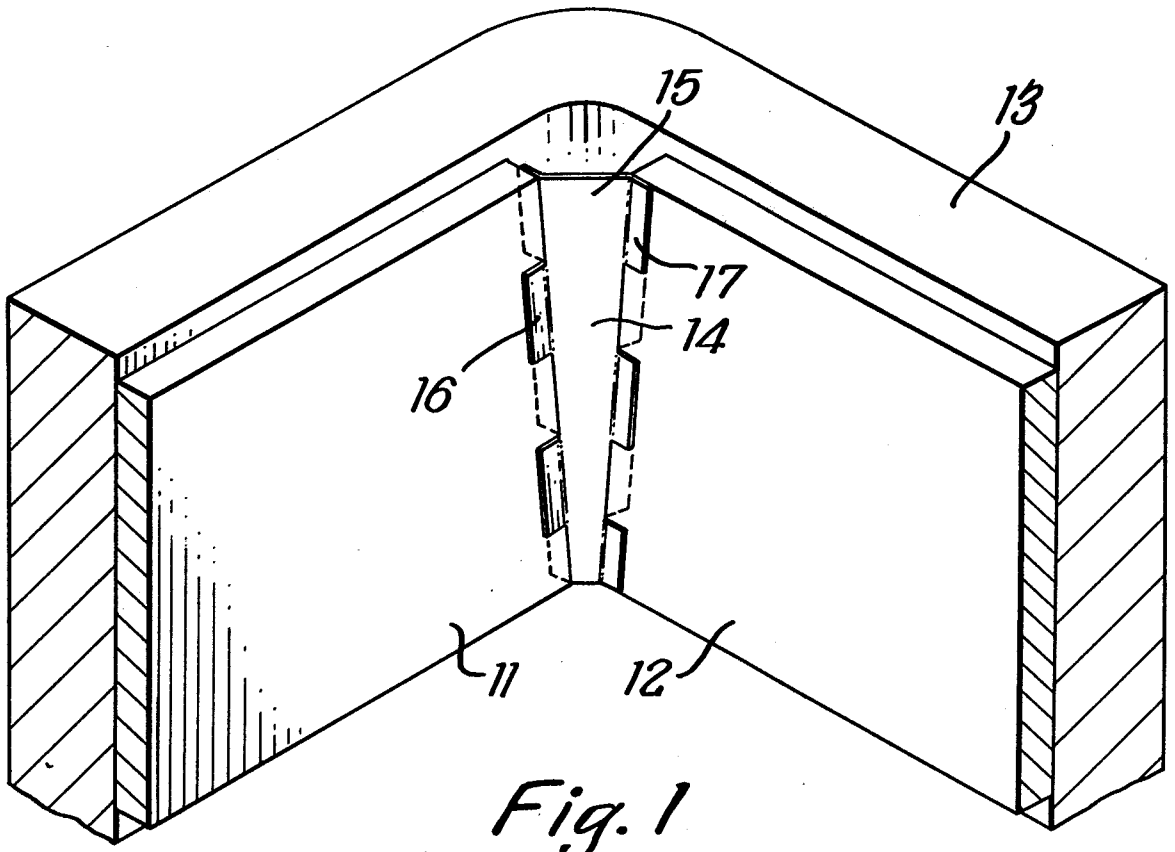

This invention relates to a hot top assembly for an ingot mould, the assembly including a number of side boards (usually four) which line the upper parts of the inner surfaces of the mould. In order to hold the side boards of such an assembly firmly in position against the mould walls, it has been proposed (U.S. Pat. Nos. 3,421,731, 3,722,848 and 3,809,355) to form downwardly extending grooves in the inner surfaces of the side boards and to provide at each corner of the mould a securing device which fits with a wedge or spring action into the grooves of two adjacent side boards, thus forcing them outwardly against the mould walls.

The presence of grooves in the side boards is a weakness which may lead to breakage and to overcome this difficulty a hot top assembly has been proposed (U.S. Pat. No. 3,749,350) in which the side boards are so shaped that at each corner of the mould a gap which tapers downwardly in width is left between the ends of two of the side boards, each of these gaps receiving a wedge member for forcing the two side boards apart and into engagement with the mould walls. The wedge member is constituted by a plate which tapers downwardly in width and has each of its downwardly extending margins bent rearwardly (that is outwardly of the mould) through an angle of some 135° the extremity of the marginal portion being bent in the reverse direction through an angle of some 90°. There is thus formed behind (outside) each downwardly extending edge of the wedge member a continuous V-section channel, the walls of which engage respectively with the inner surface and the end surface of one of the side boards, the metal of which the wedge member is formed having sufficient resilient flexibility to allow the side walls of the channel to exert a spring pressure on the side boards.

Wedge members of this known form require for their construction a relatively large quantity of expensive metal and the members occupy considerable space during storage and transport.

The present invention provides in, or for use in, a hot top assembly for an ingot mould, a securing device constituted by a plate which tapers in width along its length and has at each end of its longitudinal edges an integral marginal portion which is divided transversely to provide two or more separate flanges, each extending over only part of the length of the plate, one or more of these flanges projecting forwardly from the plate and the remainder projecting rearwardly from the plate, the two flanges, or sets of flanges, at each longitudinal edge of the plate lying at such an angle to one another that when the securing member is inserted into the gap left at a corner of the mould between two of the side boards of the hot top assembly, the said flanges will respectively engage the inner surface and the end surface of one of the said two side boards.

This construction substantially reduces the amount of material required to form the wedge member, facilitates their manufacture, and allows the use of relatively low cost metal such as mild steel or low carbon steel, or even a suitable plastics material such as polypropylene. Moreover, any number of the wedge members of the invention can be nested together so that they occupy very little space during storage and transport and it is made easy for a workman to carry in a single load all the components required for the erection of the hot top assembly in the ingot mould.

Securing devices in accordance with the invention may, and preferably do, possess some or all of the following additional features: each marginal portion provides three or more flanges which project alternately forwardly and rearwardly from the plate, the flanges at each edge of the plate together occupy substantially the full length of the plate, each of the flanges at one edge has substantially the same dimensions as the flange on the other edge which lies opposite to it, the two members of each opposite pair of flanges project in opposite directions.

Conveniently, the securing device is made from a single sheet metal blank of truncated wedge form. The marginal side portions of this blank are cut transversely at intervals and each cut portion is bent towards one flat face and towards the other flat face of the wedge. Such an operation may be performed by punching with an appropriate tool.

Suitable metals from which the device of the invention may be constructed are mild steel and low carbon steel, and, ideally the device may be constructed from a metal the same as or similar to that to be cast in the ingot mould in which the device is to be employed. Alternatively, the device may be constructed from a suitable plastics material, e.g. polypropylene.

Preferably the device of the invention has a length equal to or substantially equal to the length of the ends of the insulating side boards to be secured.

It is not essential that the central plate portion of the device be flat as described above. Thus, in one preferred embodiment the plate includes one or more longitudinal folds or corrugations, preferably two corrugations, which may extend from one end of the plate to the other end of the plate or along only part of the length of the plate. The provision of such folds or corrugations enables the device of the invention to be employed more conveniently in situations where it is necessary to accommodate variations in the lengths of the side boards or variations in mould sizes. The folds or corrugations are subject to compression as the wedge is forced into position and thereby contribute to the wedging force applied to the side boards.

Figure 2:
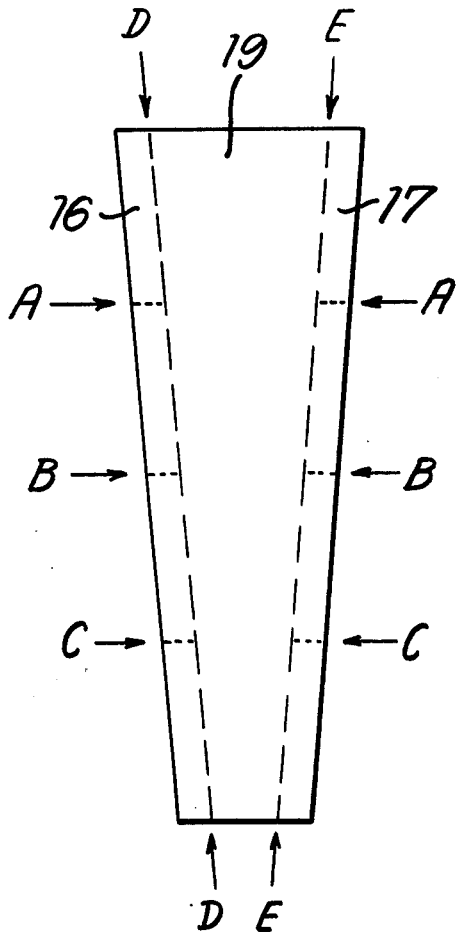
Figure 3:
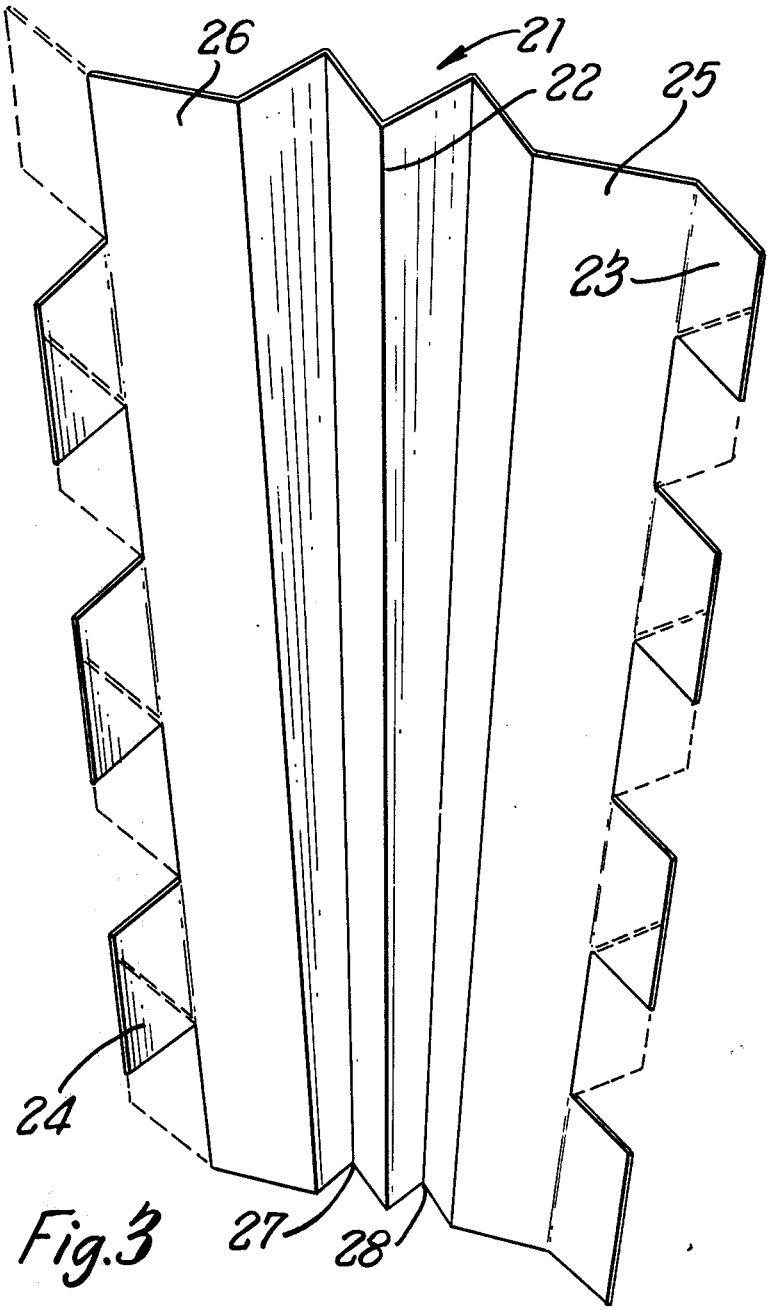

The invention will now be described by way of example with reference to the diagrammatic drawings in which:

FIG. 1 shows in perspective part of the inside of a hot top assembly with the ends of two insulating side boards secured by a device of the invention, FIG. 2 shows a flat elongated wedge from which a device of the invention can be constructed, and FIG. 3 shows in perspective a device of the invention having longitudinal folds.

Referring to FIG. 1, the part of the hot top assembly shown comprises two insulating side boards 11 and 12 positioned at about 90° to each other at the top of an ingot mould 13. The boards 11 and 12 are held in position in relation to each other by a securing device 14. The securing device 14 comprises a flat metal plate 15 of wedge form having five rectangular flanges 16 disposed on one long side and five rectangular flanges 17 disposed along with other longitudinal side. The flanges 16 and 17 are in a fixed relation to each other (that is, they are not resiliently sprung) so that the square or substantially square end of each side board can be located as shown. The flanges may be stiffened by forming indentations (not shown) in the angle joining the flange to the central plate.

It will be appreciated that when four insulating side boards are assembled around the inside of the four side walls of an ingot mould, the positioning of a device as shown at each corner of the rectangle formed by the thus-arranged side boards will serve to secure the boards in relation to each other, and, by virtue of the thrust developed by insertion of the devices between the ends of the boards as shown, in the required relation to the inside of the ingot mould.

In tests carried out to date with securing devices as shown it has been found that substantially no chilling of the contents of the ingot mould occurs at the wedges 15.

A securing device in accordance with the invention can be constructed from a flat metal blank 19 as shown in FIG. 2. The blank 19 is cut at the places indicated by dotted lines at A, B and C along longitudinal margins and then the thus-formed flanges 16 and 17 are appropriately bent out of the plane of the blank along dotted lines D and E respectively to provide a device of the configuration shown in FIG. 1. In one example the wedge was constructed from mild steel having a thickness of about 0.4 mm.

Referring to FIG. 3, a securing device 21 comprises a metal plate 22 having seven rectangular flanges 23 disposed along one longitudinal side and seven rectangular flanges 24 disposed along the opposite longitudinal side. As with the device of FIG. 1 the flanges 23 and 24 are in a fixed relation to each other so that the ends of each side board can be located as shown for the device of FIG. 1.

The plate 22 has two opposed side pieces 25 and 26 disposed in the same or substantially the same plane which are separated from each other by two longitudinal folds 27 and 28. The folds 27 and 28, as described above, provide a simple means of accommodating variations in the lengths of side boards and variations in mould sizes.

As with the device of FIG. 1, the device of FIG. 3 may be constructed from a flat metal wedge and in a similar manner, the folds 27 and 28 being formed in the plate by a suitable forming technique such as by bending at an appropriate stage in the construction.

Without further elaboration, the foregoing will so fully illustrate my invention that others may, be applying current or future knowledge, readily adapt the same for use under various conditions of service.

What is claimed as the invention is:

1. In a securing device for use in securing two side boards together in a hot top assembly for an ingot mould, each side board having an inner surface and an end surface, the securing device constituted by a single plate which tapers in width along its length, the improvement which comprises at each of the longitudinal edges of the plate an integral marginal portion which is divided transversely to provide at least a first and a second flange, each flange extending over only part of the length of the plate, one of said flanges projecting at an acute angle forwardly from the plate, and the other of said flanges projecting at an acute angle rearwardly from the plate, the flanges at each longitudinal edge of the plate lying at such an angle to one another that when the securing device is inserted into the gap left at a corner of the mould between two of the side boards of the hot top assembly, the said flanges will respectively engage the inner surface and the end surface of one of the said two side boards.

2. The securing device of claim 1, in which each marginal portion is divided into at least three flanges which project alternately forwardly and rearwardly and together occupy substantially the full length of the plate.

3. The securing device of claim 1 in which each of the flanges at one edge of the plate has the same dimensions as the corresponding flange at the opposite edge of the plate, the two members of each pair of opposite flanges projecting in opposite directions.

4. The securing device of claim 1 in which the plate is formed with at least one longitudinally extending fold.

5. The securing device of claim 1 in which the plate is formed with at least one longitudinally extending corrugation.

6. The securing device of claim 1 and formed by bending from a single blank of sheet metal.

7. The securing device of claim 1 and formed as an integral moulding of a plastics material.

8. A hot top assembly of an ingot mould including a plurality of said boards each having an inner surface and an end surface and which line the walls of the mould leaving at each corner a gap which tapers downwardly in width, and an equal number of securing devices, each constituted by a single plate which tapers in width along its length and which has at each of its longitudinal edges an integral marginal portion which is divided transversely to provide at least a first and a second flange, each flange extending over only part of the length of the plate, one of said flanges projecting at an acute angle forwardly from the plate and the other of said flanges projecting rearwardly at an acute angle from the plate, the flanges at each longitudinal edge of the plate lying at an angle to one another, and each securing device being inserted into the gap left at a corner of the mould between two of the side boards of the hot top assembly, the said flanges at each edge respectively engaging the inner surface and the end surface of one of the said two side boards, thereby holding all the side boards firmly in the required positions.

* * * * *